United States Patent [19]

Bobo

[11] 3,945,759

[45] Mar. 23, 1976

[54] BLEED AIR MANIFOLD

[75] Inventor: Melvin Bobo, Cincinnati, Ohio

[73] Assignee: General Electric Company, Cincinnati, Ohio

[22] Filed: Oct. 29, 1974

[21] Appl. No.: 518,269

[52] U.S. Cl. ..... 415/145

[51] Int. Cl.[2] ..... F04D 27/02

[58] Field of Search ..... 415/144, 145; 60/39.07, 60/39.28; 137/528

[56] References Cited

UNITED STATES PATENTS

| | | | |
|---|---|---|---|
| 2,837,270 | 6/1958 | Chapman | 415/144 |
| 3,108,767 | 10/1963 | Eltis et al. | 60/39.07 |
| 3,142,438 | 7/1964 | McKenzie | 415/144 |
| 3,597,106 | 8/1971 | Anderson | 415/144 |
| 3,777,489 | 12/1973 | Johnson et al. | 60/39.07 |

FOREIGN PATENTS OR APPLICATIONS

| | | | |
|---|---|---|---|
| 987,625 | 3/1965 | United Kingdom | 415/145 |
| 693,296 | 6/1953 | United Kingdom | 137/528 |

*Primary Examiner*—Henry F. Raduazo
*Attorney, Agent, or Firm*—Dana F. Bigelow; Derek P. Lawrence

[57] ABSTRACT

A circumferential manifold placed around an intermediate stage of the compressor to carry off bleed air for auxiliary purposes is provided with a plurality of check valves which allow the air to pass from the high pressure compartment of the compressor to the low pressure compartment of a plenum, but do not allow the air to pass from the plenum back to the manifold. Accordingly, when there is a variation in pressure around the circumferential manifold, as may be caused by distortion at the compressor inlet, the air that is bled off to the low pressure plenum comes principally from the high pressure zone of the compressor and may not reenter from the manifold on the low pressure side thereof. The fluid flow of air from one side of the manifold to the other side thereof is thus prevented, so as to limit the distortion of the normal flow pattern which would otherwise occur in the compressor.

10 Claims, 5 Drawing Figures

BLEED AIR MANIFOLD

BACKGROUND OF THE INVENTION

This invention relates generally to gas turbine engine casings and, more particularly, to such structures which are adapted for bleeding interstage air from the compressor. In a gas turbine engine wherein air passes through an inlet to the compressor and hence to a combustion chamber, it is desirable that the thermodynamic conditions of pressure, flow and temperature are uniform about the engine axis through any particular axial position therein. Any distortions of the normal flow pattern through the compressor tends to cause pressure variations across the lateral sections of the engine, thereby resulting in lower efficiency and reduced stall margin. Subsonic aircraft engines in normal flight with normal inlets generally have uniform inlet conditions and, therefore, very little distortion occurs in the airflow pattern. However, in the case of supersonic engines which fly behind supersonic inlets, or subsonic engines which operate within cross wind conditions, distortion of the airflow does tend to occur. This distortion may also occur in aircraft subsonic installations wherein an engine is located in a position such that its axis does not coincide with that of the inlet, as for example in some tail installations where the inlet duct is required to have an "S" shape.

Under the aforesaid conditions, the pressure distortion that occurs is generally highest toward the front of the engine and attenuates as the air moves aft through the engine, but it is not unusual to find substantial pressure variations even as far aft as the combustor.

In order to provide pressurized air for operation of airframe engine accessories such as environmental conditioning, anti-icing, turbine cooling, etc., it is common to include a compressor casing structure which permits bleeding of high pressure air from the compressor to a low pressure plenum. Preferably, this interstage bleeding is accomplished by means which provide minimal interference with the normal airflow patterns in the compressor, but because the manifold provides a communication between areas of high pressure and areas of low pressure, it is possible that air may bleed from one side of the engine to the other side thereof through the manifold. This is particularly true during flight conditions wherein only small amounts of air are being bled from the engine. This communication of air from one side of the engine to the other tends to distort the normal flow pattern in the compressor, or to further the distortion which may be caused by any of the conditions discussed hereinabove.

It is therefore the object of the invention to provide a means of extracting bleed air from an engine that must operate under a variety of pressure distortion conditions in a way that will result in a minimum loss in compressor efficiency and stall margin.

Another object of this invention is to provide in a gas turbine engine a bleed-off system which does not substantially distort the uniform flow of air through the compressor.

Another object of this invention is the provision in a gas turbine engine for an air bleed-off system which operates efficiently over a wide range of flight conditions, wherein varying amounts of air are being bled from the engine.

Another object of this invention is the provision in a gas turbine engine for an air bleed-off manifold which does not allow the air to bleed from one side of the engine to the other through the manifold.

Another object of this invention is the provision for a compressor air bleed-off system which is economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, a plurality of check valves are installed in circumferentially spaced positions in the exhaust manifold of a gas turbine compressor interstage bleed system. When the flow of air through the compressor is relatively undisturbed, then the pressure of the air communicating with the exhaust manifold is substantially uniform around the entire periphery of the engine, and all of the check valves open uniformly to bleed off air in a balanced pattern around the engine so as not to distort the airflow within the combustor. However, if the airflow in the compressor has been distorted by any of the well-known conditions as discussed hereinabove, then there will be an imbalance in air pressures around the engine periphery when it reaches the exhaust manifold. Instead of allowing the compressor air in the higher pressure areas to pass through the manifold to the compressor lower pressure areas, the check valves in the vicinity of the higher pressure areas open to allow the air to be bled off, but the check valves in the lower pressure areas remain closed so as not to allow air to pass through the manifold in either direction. The result is that the manifold does not cause further distortion of the airflow pattern by the flow back of air from the manifold to the compressor, but instead tends to reduce the variation in pressures around the periphery of the engine by bleeding off air at the high pressure areas thereby bringing the pressures closer to conformance with those of the low pressure areas to thereby establish more uniform pressure distribution throughout the engine.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
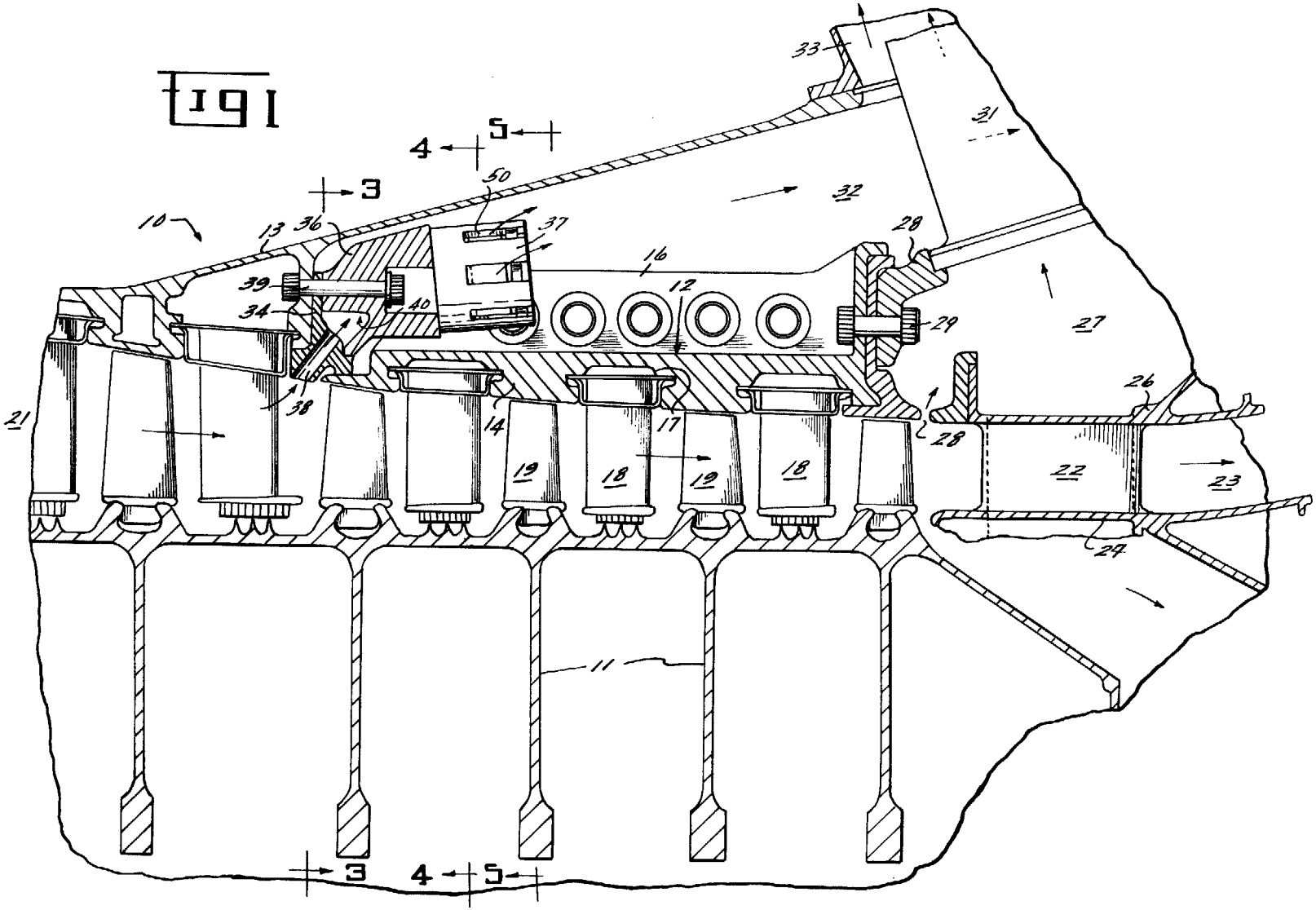
FIG. 1 is a partial longitudinal cross-sectional view of a gas turbine compressor and associated bleed-off manifold in accordance with the preferred embodiment of this invention.
Figures 2, 3, 4, 5:
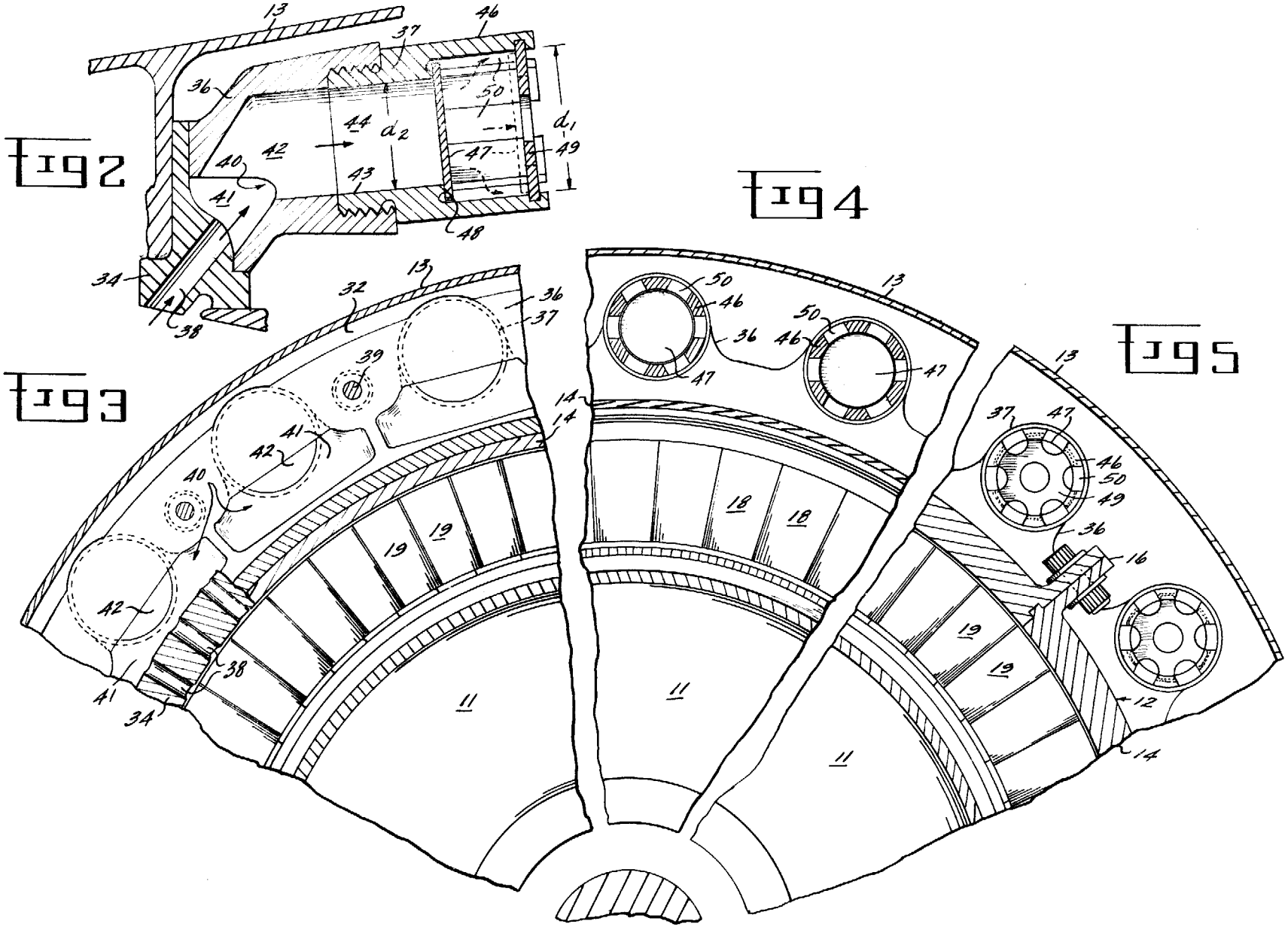
FIG. 2 is an enlarged cross-sectional view of the manifold portion thereof with the check valves intalled therein in accordance with the preferred embodiment of the invention.
FIGS. 3, 4 and 5 are partial cross-sectional views of the bleed-off system as seen along lines 3—3, 4—4 and 5—5 of FIG. 1, respectively.

Referring now to FIG. 1, the compressor is shown generally at 10 as comprising a rotor 11 around which a compressor inner casing 12 and outer casing 13 are concentrically disposed. The inner casing 12 comprises a pair of semicylindrical walls 14 joined at the inner casing split line by mating flanges 16 (FIG. 5). The walls 14 have disposed therein a plurality of stator support members 17, each of which support a stage of stator blades 18 therein. Located between adjacent stator blade stages is a stage of compressor or rotor blades 19 which are attached to and rotated by the rotor in a conventional manner so as to compress air which enters at the air inlet 21 zone and is discharged through a compressor inlet guide vane 22, a diffuser passageway 23 and hence to a combustor (not shown) in a conventional manner, as shown and described in U.S. Pat. No. 3,777,489 - issued to Johnson et al. on Dec. 11, 1973 and assigned to the assignee of the present invention.

Forming the diffuser passage 23 is the diffuser inner wall 24 and outer wall 26 which together form an integral casting with the cascade of compressor outlet guide vanes 22. The diffuser outer wall 26 partially defines an annular plenum 27 which receives bleed-off air from the last stage of the compressor through an opening 28. Further defining the plenum 27 is a support cone 28 which is attached to the compressor inner casing 12 by way of bolt means 29. Attached to and supported by the support cone is a tube 31 which communicates with the plenum 27 to carry the bleed air to various locations within the aircraft for operation of auxiliary equipment in a conventional manner.

In addition to the compressor air bleed-off system as just described, a bleed-off system is commonly installed to extract air from the compressor duct at a point surrounding an intermediate stage of the compressor. This inner stage bleed-off system as it is commonly called is designed to pressurize annular plenum 32 partially defined by the compressor inner and outer casings 12 and 13, respectively. The pressurized air in the annular plenum 32 then flows downstream, a portion in the direction indicated by the dotted arrow to cool the combustor outer casing and downstream turbine stator components, and a portion through the passageway 33 to be used in various auxiliary equipment throughout the aircraft as is shown and described in U.S. Pat. No. 3,777,489, referenced hereinbefore.

Fluidly interconnecting the compressor high pressure chamber and the lower pressure annular plenum 32 are the serially connected nozzle ring 34, air bleed-off manifold 36 and a plurality of check valves 37. The nozzle ring 34, which circumscribes the compressor at an interstage thereof includes a plurality of orifices 38 which extend radially therethrough to fluidly communicate at their one end with the compressor high pressure chamber, and at their other end with the manifold 36. Abutting the downstream side of the annular ring is the manifold 36 which is held in place, along with the nozzle ring 34 by a plurality of bolts 39 which rigidly fix them to the compressor outer casing 13. A plurality of recesses 40 at the upstream end of the manifold 36, together with the outer surface of the nozzle ring 34, form a plurality of circumferentially spaced cavities 41 into which the respective orifices 38 discharge the bleed-off air. Individual cavities 41 then communicate with associated flow chambers 42 within the manifold to carry the air to the check valve 37. It should be mentioned that the manifold 36 may be in the form of a single annular ring having a plurality of circumferentially spaced flow chambers 42 formed therein, or it may comprise semicircular sections which are connected by flanges and bolts similar to that of the inner casing walls 14 as shown in FIG. 5. Further, it may comprise a plurality of sections which are circumferentially spaced and connected by flange and bolt means to circumscribe the entire engine. Similarly, the nozzle ring 34 may comprise a single circumferential ring, a pair of semicircular rings, or a plurality of arcuate sections interconnected to form a complete ring.

Connected to the manifold 36, at each of its flow chambers, is a check valve 37 which forms an extension of the manifold at that point and selectively provides fluid communication from its respective flow chamber to the annular plenum 32. The check valve 37 is preferably cylindrical in nature and may be secured to the manifold 36 by thread means as shown in FIG. 2. Its inner wall 43 defines a flow path 44 which communicates directly with and forms an extension of the flow chamber 42. The check valve 37 is of conventional construction and comprises a stepped cylindrical wall structure 46 wherein the discharge inner diameter $d_1$ is greater than the inner diameter $d_2$ of the inlet. The wall 46 has a plurality of slots 50 formed therein (FIGS. 1 and 5) which allow the air to pass through to the plenum 32 when the valve is open. Disposed in the discharge end of the structure is a circular plate 47 whose diameter is smaller than $d_1$ but greater than $d_2$. The plate is free to move axially within the inner diameter $d_1$ so as to close the valve or open at varying degrees. When in the closed position, the plate is in the far left position as shown in FIG. 2 wherein it rests against an annular shoulder 48 so as to prevent the flow of air through the valve in either direction. When the valve is moved to the open position, as will occur when the high pressure air enters the chamber 42, the plate 47 will be in the far right position as shown by the dotted line in FIG. 2. When the valve is in this position the air is allowed to pass into the chamber defined by the inner diameter $d_1$ and to escape through the slots 50 to the surrounding plenum 32 as shown by the arrows of FIG. 1. The plate 47 is retained within the inner diameter compartment by the cover 49 which is fixed in the discharge end of the valve by a tongue-and-groove arrangement or the like.

In operation, the check valves within the manifold will operate as follows. When the compressor airflow pattern in the vicinity of the manifold is substantially uniform around the entire engine circumference, all of the check valves will be caused to open to approximately the same degree, and the air will be bled off uniformly about the circumference of the compressor so as to not substantially distort the airflow within the compressor. When a distortion has already occurred, as for example by a peculiar inlet condition, and as a result the compressor pressures are not uniform around the engine at the compressor side of the manifold, then the check valves which are exposed to the compressor higher pressure are opened to let the air bleed off into the plenum 32. This higher pressure air will then flow across the manifold to act on the outer side of the check valves which are located in areas of compressor lower pressures, to close them and prevent them from bleeding off any air in that vicinity. The result in the compressor is that the higher pressures are reduced by the bleed-off and the lower pressures remain substantially the same, so as to bring about greater pressure uniformity around the circumference of the engine.

Having thus described the invention what is claimed as novel and desired to be secured by Letters Patent of the United States is:

1. An improved turbomachine bleed-off arrangement of the type having a high pressure annular compartment, a low pressure compartment subject to circumferential variable pressure flow and a manifold to conduct the flow of air therebetween, wherein the improvement comprises:

an annular extending manifold having a plurality of circumferentially spaced passages formed therein for conducting the flow of air from the high pressure compartment to the low pressure compartment; and a check valve disposed in each of said passages, said valves having means for allowing the flow of air only from the high pressure compartment to the low pressure compartment.

2. An improved turbomachine bleed-off arrangement as set forth in claim 1 wherein the high pressure compartment fluidly communicates with a rotary upstream compressor which moves air along its axis toward a downstream engine combustor.

3. An improved turbomachine bleed-off arrangement as set forth in claim 2 wherein the axes of said passages are substantially parallel to the axis of said compressor.

4. An improved turbomachine bleed-off arrangement as set forth in claim 1 wherein said manifold comprises an annular ring.

5. An improved turbomachine bleed-off arrangement as set forth in claim 1 and including an annular nozzle ring interposed between said high pressure compartment and said manifold, said nozzle ring having a plurality of nozzles formed therein for conducting the flow of air to said manifold and to said check valves.

6. An improved turbomachine bleed-off arrangement as set forth in claim 5 wherein said nozzles have axes forming an oblique angle with the axes of said passages.

7. A compressor bleed-off system for a gas turbine engine comprising:

a circumferential manifold surrounding an axial portion of the compressor, and a low pressure plenum therefrom;

a plurality of circumferentially spaced passages formed in said manifold, said passages fluidly communicating with the compressor at one end thereof and with the low pressure plenum at the other end thereof; and a check valve installed in each of said passages for preventing the flow of air from the low pressure plenum into said passages.

8. A compressor bleed-off system as set forth in claim 7 wherein said passages have axes that are substantially parallel with the axis of said compressor.

9. A compressor bleed-off system as set forth in claim 7 and including a plurality of nozzles positioned adjacent the compressor to carry the flow of air from the compressor to said passages.

10. A compressor bleed-off system as set forth in claim 9 wherein said nozzles are disposed with their axes forming an oblique angle with the axis of said compressor.

* * * * *